US007059788B2

(12) United States Patent
Pearl et al.

(10) Patent No.: US 7,059,788 B2
(45) Date of Patent: Jun. 13, 2006

(54) PRINTER MEDIA COMPRISING A BAR CODE

(75) Inventors: Dennis Eugene Pearl, Boise, ID (US); Mark Anthony Schilz, Boise, ID (US); Matthew Richard Hansen, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 97 days.

(21) Appl. No.: 10/358,479

(22) Filed: Feb. 5, 2003
(Under 37 CFR 1.47)

(65) Prior Publication Data

US 2004/0151526 A1 Aug. 5, 2004

(51) Int. Cl.
*B65H 75/00* (2006.01)

(52) U.S. Cl. ..... 400/242; 400/244; 400/583.3; 400/706; 400/711; 235/463

(58) Field of Classification Search ..... 400/630, 400/583.3, 706, 709, 711, 242, 244, 103; 235/462, 463; 226/20
See application file for complete search history.

(56) References Cited

U.S. PATENT DOCUMENTS

| | | | | |
|---|---|---|---|---|
| 4,463,251 | A | 7/1984 | Koutonen et al. | |
| 5,053,814 | A | 10/1991 | Takano et al. | |
| 5,078,522 | A * | 1/1992 | Nishizawa et al. | 400/583.3 |
| 5,079,565 | A * | 1/1992 | Shimizu et al. | 347/172 |
| 5,250,787 | A * | 10/1993 | Arii et al. | 235/375 |
| 5,947,408 | A | 9/1999 | Miyake | |
| 6,244,511 | B1 * | 6/2001 | Vandenberg et al. | 235/462.45 |
| 6,336,718 | B1 * | 1/2002 | Blanchard et al. | 347/84 |
| 2003/0063315 | A1 * | 4/2003 | Nunokawa | 358/1.16 |

FOREIGN PATENT DOCUMENTS

| | | |
|---|---|---|
| CH | 665 593 | 5/1988 |
| CH | 665 593 | 5/1998 |
| JP | 2000 85204 | 8/1989 |
| JP | 1209162 | 8/1989 |
| JP | 4 45959 | 2/1992 |
| JP | 6 31967 | 7/1992 |
| JP | 405301673 | * 11/1993 |
| JP | 9 301551 | 11/1997 |
| JP | 2000 1002 | 6/1998 |
| JP | 2000 85204 | 9/1998 |

* cited by examiner

*Primary Examiner*—Andrew H. Hirshfeld
*Assistant Examiner*—Marissa Ferguson

(57) ABSTRACT

A printer and printer media are provided. The printer comprises a media support for receiving a print media. The media support includes a bar code reader. The media comprises a printable media and a bar code disposed on the media.

16 Claims, 4 Drawing Sheets

PRINTER MEDIA COMPRISING A BAR CODE

BACKGROUND

Currently, different media types are used in printers. One such example is that of rolled media which is commonly used in large format printers. There are also several different rolled media types manufactured by different companies. Large format printers are relatively expensive and should be capable of using a variety of media types. In connection with most printers, different media types are used for different print applications and often require different print parameters for effective printing. For example, some media types receive different ink, some can run quicker than others and the drying time may be different depending on the media used. The print parameters are typically capable of being adjusted on the printer.

Additionally, it is relatively common that print media are installed backwards in the printer, particularly with the relatively large print media for large format printers. This could possibly adversely affect the print job.

Currently, the information about the print media, i.e. type, lot, media size etc is contained only on the packaging information. Frequently, the packaging material is discarded once the media is loaded into the printer. The absence of information about the print media type could possibly result in the printer being set to the improper parameters for the particular print job.

SUMMARY

According to one representative embodiment, there is provided a printer. The printer comprises media support for receiving a print media. The media support includes a bar code reader thereon.

According to another representative embodiment, there is provided a media for use in a printer. The media comprises a media core. A printable media is disposed on the core. A bar code is disposed on the media core.

A method of detecting a media type on a printer of the type including a housing and a media support for receiving a media is also provided. The method comprises the steps of positioning a media having a bar code thereon on the media support of the printer and reading the bar code with a bar code reader on the media support.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

The following description of the preferred embodiment(s) is merely exemplary in nature and is in no way intended to limit the invention, its application, or uses.

Figure 1:
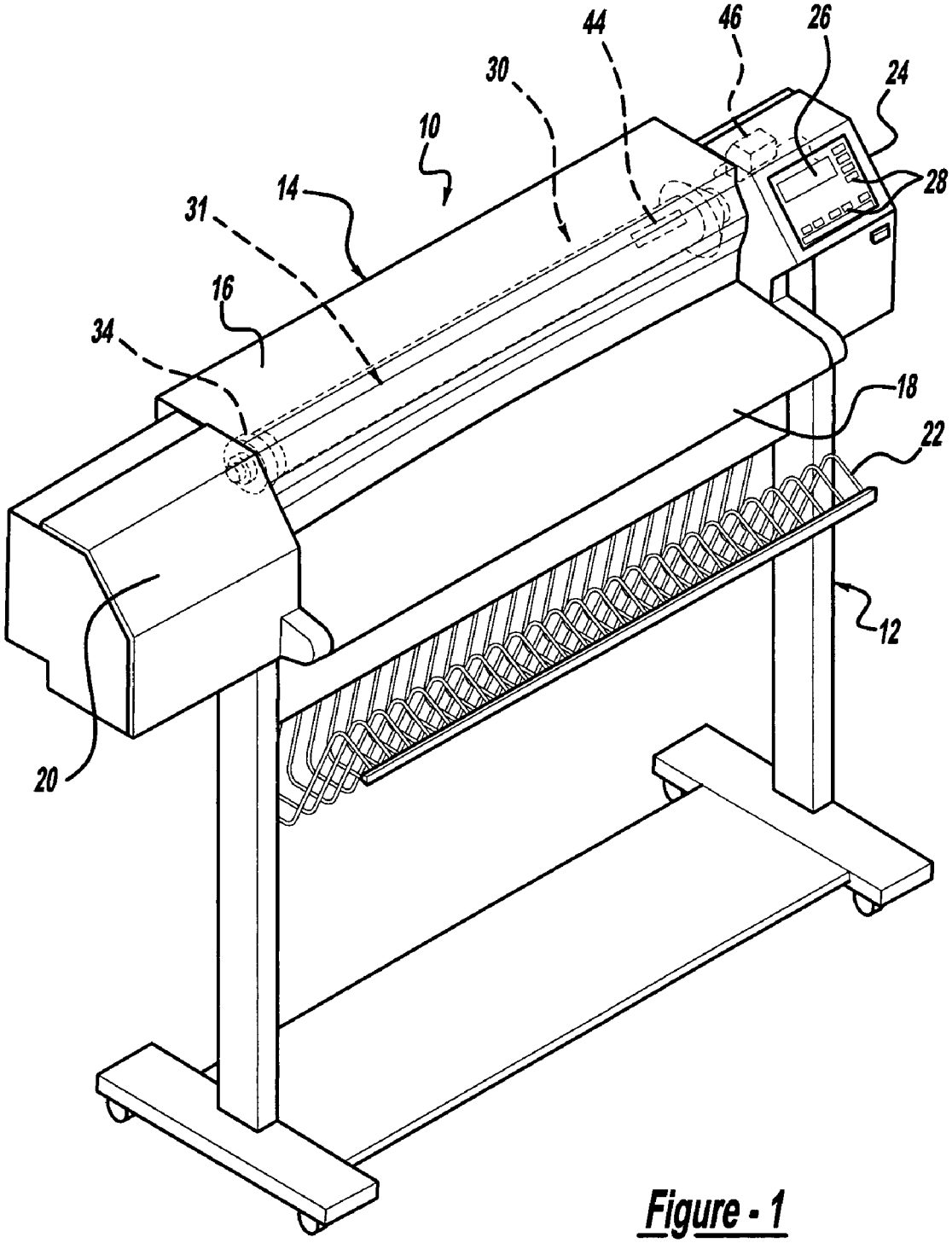
FIG. 1 is a perspective view of one embodiment of a printer in accordance with the present invention.

FIG. 1 is a perspective view of one embodiment of a printer. In FIG. 1, a printer is generally shown at 10. The printer 10 shown is a large format printer. It will be appreciated that while the printer shown in FIG. 1 is a large format printer, the present invention is useable in connection with any suitable printer. The printer 10 includes a stand, generally indicated at 12. A housing, generally indicated at 14, is supported on the stand 12. The housing 14 includes a hinged cover 16. The hinged cover 16 can be pivoted to an open position to allow access to the interior of the housing 12.

The printer 10 also includes a generally horizontally extending platen 18 over which printed media is discharged. To the left of the platen 18 is contained a separate hinged cover 20. This hinged cover 20 is pivotal to provide access to the portion of the housing 14 that may contain other printer components, such as ink cartridges (not shown).

The printer 10 further contains a media receiving tray 22. The media receiving tray 22 is for receiving the printed media, after it has passed over the platen 18. The media receiving tray 22 holds the printed media until a user removes it. The printed media is not shown in FIG. 1.

The printer 10 further includes a control panel, generally indicated at 24. The control panel 24 may include a display panel 26. The display panel 26 may display information about the print media, status of the print job, operating instructions, or any other information that may be related to the function of the printer or media. Additionally, the control panel 24 may include a plurality of function buttons 28. The function buttons may provide for any of a variety of functions. These can include, but are not limited to setting the print parameters of the print job.

Figure 2:
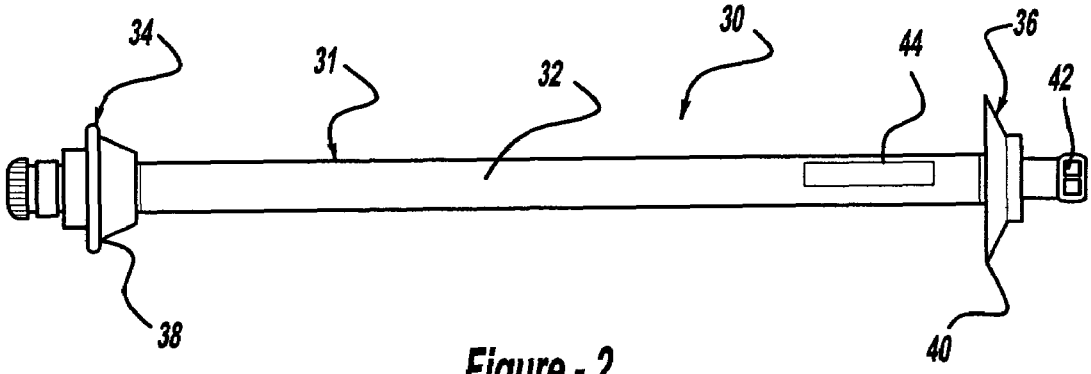
FIG. 2 is a plan view of the media support of FIG. 1.

A media support, generally shown at 30 is supported in the housing 12. FIG. 2 is a plan view of the media support 30. As shown in FIG. 1, the media support 30 comprises a spindle generally indicated at 31, rotatably supported in the housing 12. The spindle 31 is best seen in FIG. 2. The spindle 31 comprises a shaft 32 onto which the print media is placed. FIG. 2 is a plan view of the media support. As shown in FIG. 2, a pair of end caps 34, 36 are placed on the end of the shaft 32 and are adapted to retain the print media therebetween. More specifically, the end caps 34, 36 each contain an outer flange 38, 40, respectively. The print media is supported on the shaft 32 between the flanges 38, 40 of end caps 34, 36.

The spindle 31 preferably includes electrical contacts 42. The electrical contacts 42 can be either on the shaft 32 or on the end cap 40. The electrical contacts 42 are coupled with a bar code reader 44. The bar code reader or sensor 44 may be of any type. One such example is an infrared bar code reader 44, as is known. The electrical contacts 42 provide power and signal communication ability to and from the bar code reader 44.

The electrical contacts 42 are coupled with a processor 46, shown schematically in FIG. 1. The bar code reader 44 generates a signal that is transmitted through the electrical contacts to the processor 46. The processor 46 can be programmed to perform any number of functions in response to the signal generated by the bar code reader 44. It will be appreciated that any suitable processor 46 may be used within the scope of the present invention. Preferably, the processor 46 is operatively associated with the control panel 24 as is shown schematically in FIG. 1. The processor may also receive additional signals from other sources.

Figure 3:
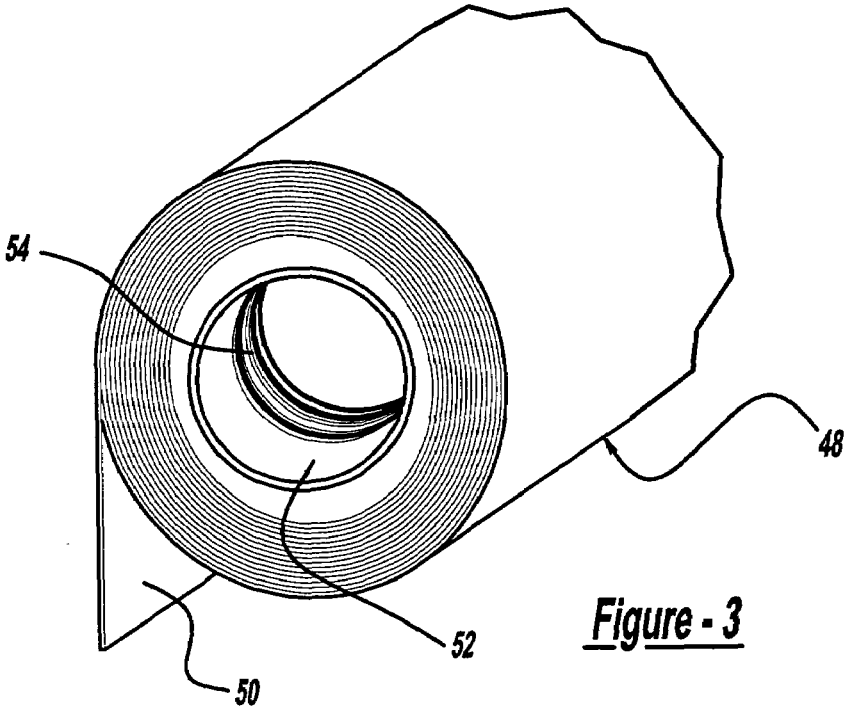
FIG. 3 is a perspective view partially broken away of one end of one embodiment of a media type.
Figure 4:
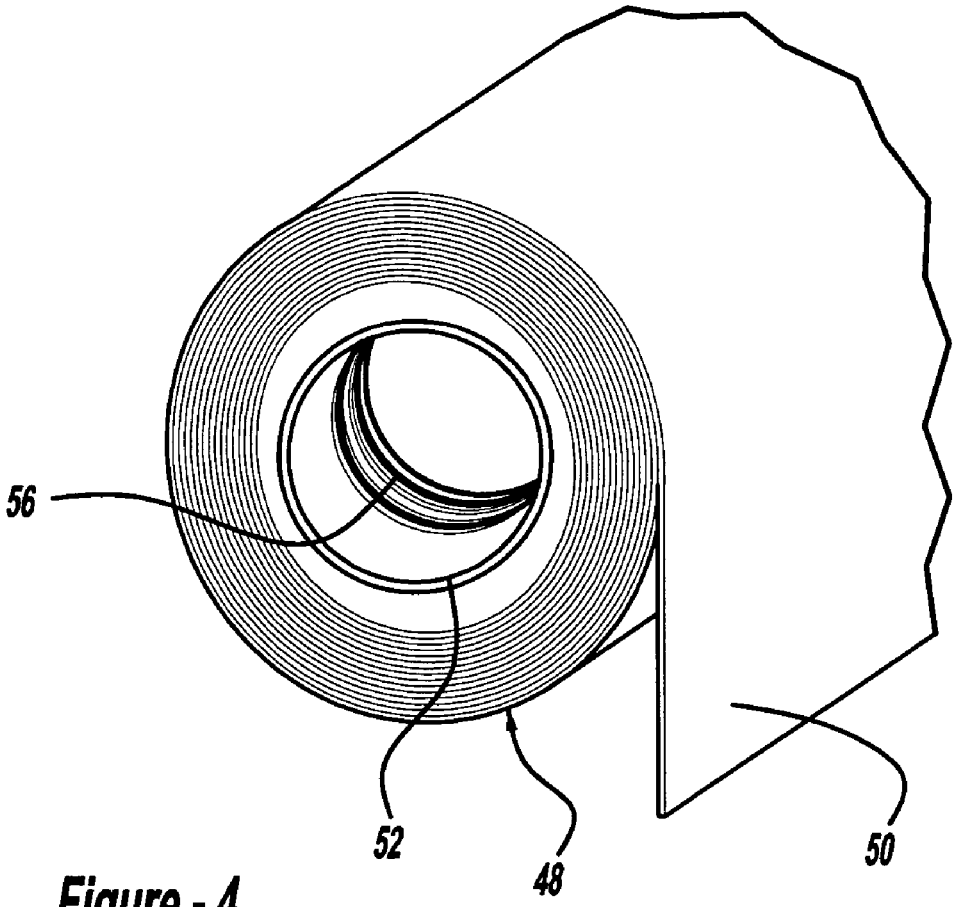
FIG. 4 is a perspective view partially broken away of a second end of one embodiment of a media type.

FIGS. 3 and 4 are perspective views, partially broken away of first and second ends of one embodiment of a media type. The shaft 32 is adapted to receive a print media, generally indicated at 48 in FIGS. 3 and 4. As shown in FIGS. 3 and 4, the print media 48 is disposed on a core 52. Typically, in connection with large format printers, the print media 48 comprises a print paper 50 that is rolled onto a core 52. The core 52 can comprise any material, including, for example, cardboard or plastic. In order to insert the print media 48 onto the shaft 32, at least one end cap 34, 36 must be removed from the shaft 32. The media 48 is then inserted over the shaft 32. After the media 48 is inserted onto the shaft, the removed end cap 34, 36 is replaced and the media is thus secured on the shaft 32 between the end caps 34, 36.

As shown in FIGS. 3 and 4, when a rolled print media 48 is used, it is preferred that a bar code 54, 56 be placed adjacent one end thereof. More specifically, the rolled media 48 extends between first 58 and second 60 ends. The bar code 54 is placed on an inner wall of the core 52 adjacent the first end 58. An additional bar code 56 may be placed on an inner wall of the core 52 adjacent the second end 60. When the first bar code 54 is detected, an indication is made that the rolled media 48 is loaded in the proper orientation. If the second bar code 56 is detected by the bar code reader 44, an indication is made that the rolled media 48 on the spindle 31 is loaded backwards. The bar codes 54, 56 are preferably positioned on the core 52 at a location so that it is placed in proximity to the bar code reader 44 when the media 48 is installed on the shaft 32. It is further preferred that the bar code 54, 56 be disposed annularly about the core 52. In this manner, the bar code reader 44 can scan the bar code 54, 56 when the media 48 is installed on the shaft 32.

The bar code 54, 56 may indicate a myriad of types of information. For example, the bar code 54, 56 may contain data about the type of media, lot number, the size of the media and the required print parameters for the media. Once the bar code reader 44 detects the bar code 54 and the information is captured, a signal is sent to the processor 46. The processor 46 can translate the signal and perform any of a multitude of operations. For example, the processor can interface with the control panel 24 to send a signal to the control panel 24 to set the appropriate print parameters on the printer 10 for the type of media 48 loaded. In this manner, manual setting of the print parameters using the function keys 28 can be avoided. Similarly, the processor 46 can send a display signal to the display panel 26 to display information about the media 48 loaded, such as media type and lot number. Additionally, the processor, having receive a signal regarding media size may receive an appropriate signal to track the media use by the printer 10 and can send an appropriate display signal to the display panel 26 providing either media usage or amount of remaining media.

While only one bar code 54 is necessary to be on the core 52 adjacent the first end 58, it may be desirable to place a second bar code 56 adjacent the second end 60. If a second bar code 56 is used as shown in FIG. 4, and the media 48 is loaded in a reverse orientation in the printer 10, the second bar code 56 can provide a code for the bar code reader 44, which indicates that the media 48 is loaded backwards. The processor 46 can then process this signal and an appropriate error display may be sent to the display panel 26. Additionally, if no bar code is detected, the processor can generate an appropriate display signal for the display panel 26. The display panel 26 may show an appropriate error message indicating that no code was detected, or indicating that the print quality cannot be guaranteed, because no print parameters were set.

While the bar codes 54, 56 are shown adjacent the ends 58, 60 respectively, it will be appreciated that the bar codes 54, 56 may be at any location on the core 52. Similarly, the bar code reader 44 may be at any location on the shaft 32. All that is necessary is that at least one of the bar codes 54, 56 be in a location that is capable of being detected by the bar code reader 44. It is further preferred, although not necessary, that the bar code 54, 56 not be centered in the core 52. In this manner more than one bar code 54, 56 can be used. Again the use of more than one bar code 54, 56 can aid in providing information regarding the orientation of the media 48, particularly if the media 48 is loaded in a reverse orientation.

Figure 6:
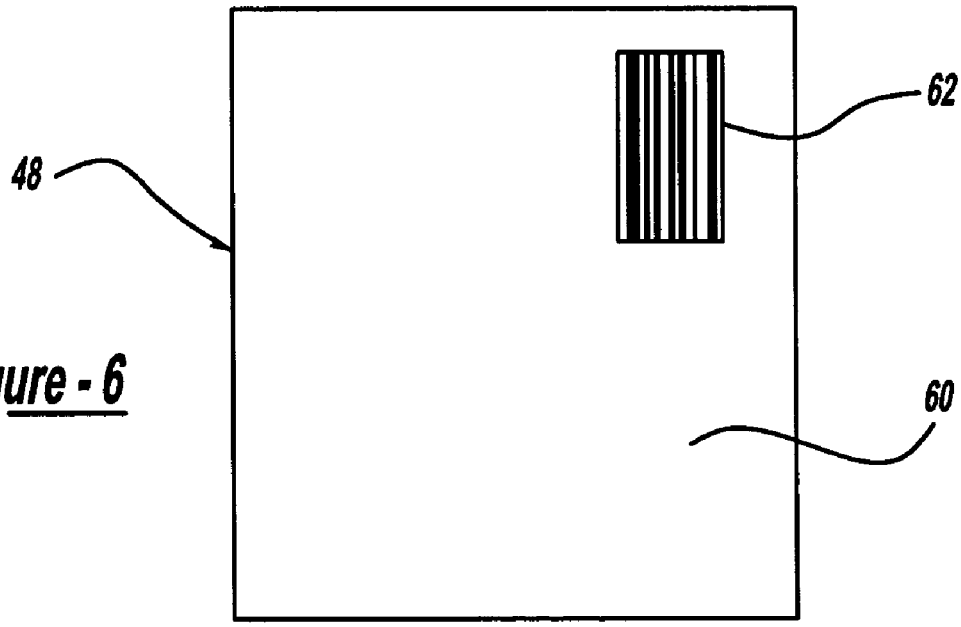
FIG. 6 is a plan view of an alternate embodiment of a media type.

It will be appreciated that while the media type disclosed is of the rolled variety, any media type can be used in accordance with the present invention. If flat or sheet media is used, the spindle 31 may also be replaced by a suitable media support, such as for example a feed tray. Similarly, the location of the bar code and bar code reader may need to be altered to allow the bar code reader to read the bar code on the flat or sheet media. FIG. 6 is a plan view of another embodiment of print media 48. As shown in FIG. 6, the print media 48 comprises a flat or sheet media 60. The flat or sheet media 60 includes a bar code 62. The bar code 62 may be located on a sheet of media 48 as shown, a backing sheet, such as a cardboard sheet, a tab on any sheet of flat media 60, or any other suitable location. It may only be necessary to include the bar code on one sheet if sheet media is used.

Figure 5:
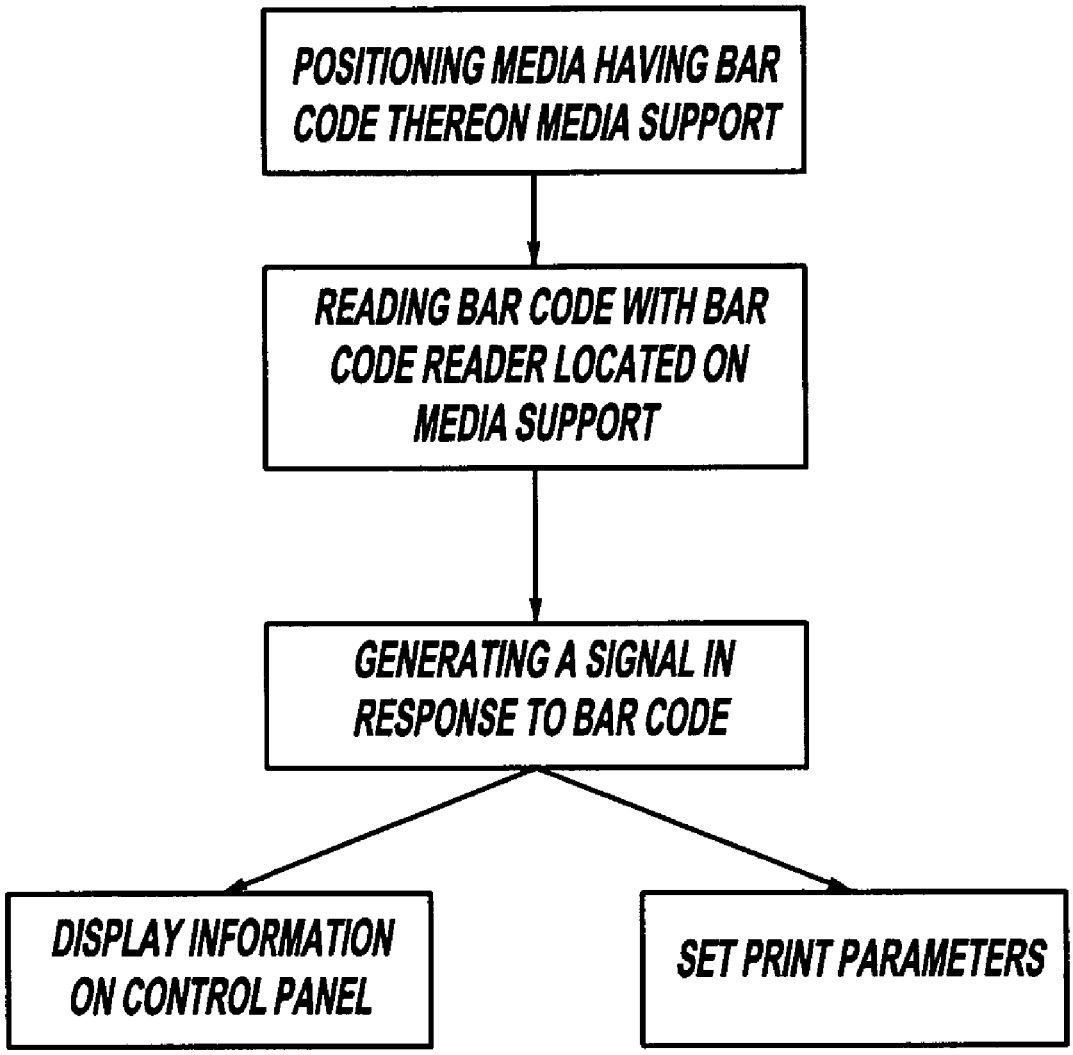
FIG. 5 is a flow chart of one representative method.

In use, there is provided a method of detecting a media type on a printer 10. FIG. 5 is a flow chart of one representative method. A printable media 48 having a bar code 54, 56, 62 is positioned on a media support 30. The media support includes a bar code reader 44 thereon. The bar code is then read with the bar code reader 44.

More specifically, and in connection with the embodiment shown in FIGS. 1–4 one end cap 34, 36 is removed from the spindle 32. The core 52 having the print paper 50 thereon is positioned over the spindle 32. The bar code 54 of the first end is positioned in proximity to the bar code reader 44 on the spindle 32. The removed end cap 34, 36 is then replaced and the spindle 32 is inserted in the housing 14. The electrical contacts 42 make appropriate contact with the corresponding printer components.

The bar code reader 44 detects the bar code 54 and generates a signal that is sent to the processor 46. In turn, the processor 46 generates one or more signals resulting in the displaying of a message on the display panel 26 of control panel 24 and/or the setting of various print parameters on the printer 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A printer comprising:

a media support for receiving a print media, said media support comprising a spindle, wherein said spindle includes a bar code reader and electrical contacts thereon, and wherein said spindle includes at least one end cap, said electrical contacts disposed on said end cap and operatively associated with said bar code reader to provide power and signal communication ability with said bar code reader.

2. The printer as set forth in claim 1 further comprising a processor, said processor adapted to receive a signal from said bar code reader, generated in response to said bar code reader detecting a bar code on a print media or said media support.

3. The printer as set forth in claim 2 further comprising a control panel, said processor adapted to interface with said control panel, to provide information to said control panel.

4. The printer as set forth in claim 3 wherein said processor generates a signal in response to said signal from said bar code reader to display a message on said control panel.

5. The printer as set forth in claim 2 wherein said processor generates a signal in response to said signal from said bar code reader to set the print parameters of the printer.

6. The printer as set forth in claim 1 further including a print media, said print media including a bar code, said bar code comprising information related to said print media.

7. The printer as set forth in claim 6 wherein said bar code comprises information relating to at least one of media type, media size, media orientation, media lot number and print parameters.

8. A method of detecting a media type on a printer of the type including a media support comprising a spindle having electrical contacts operatively associated with the bar code reader for receiving a media comprising;

positioning a media having a core defining an inner wall and a bar code on the inner wall on the spindle;

reading the bar code on the inner wall of the core with a bar code reader located on the spindle; and providing an end cap on the spindle wherein the electrical contacts are disposed on the end cap, the electrical contact operatively associated with the bar code reader to provide power and signal communication ability with the bar code reader.

9. A method as set forth in claim 8 further comprising the step of generating a signal in response to the reading of the bar code, and sending a signal to a control panel of the printer.

10. A method as set forth in claim 9 further comprising the step of displaying information on the control panel of the printer based on the signal generated in response to reading the bar code.

11. A method as set forth in claim 10 further comprising the step of generating a signal in response to the reading of the bar code, and using the signal to set print parameters of the printer.

12. A printer comprising:

media support means comprising a spindle for receiving a print media having a bar code thereon;

bar code reader means on said spindle for reading said bar code on said print media, and generating a signal in response thereto;

electrical contact means operatively associated with said bar code reader for providing power and signal communication ability with said bar code reader; and wherein said spindle includes at least one end cap, said electrical contact means disposed on said end cap.

13. The printer as set forth in claim 12 further comprising electrical means on said media support from providing power and communication ability with said bar code reader means.

14. The printer as set forth in claim 12 further comprising processor means for receiving said signal from said bar code reader means and generating a signal in response thereto.

15. The printer as set forth in claim 14 further comprising control panel means for receiving said signal from said processor means and for displaying information about said print media thereon.

16. The printer as set forth in claim 14 further comprising control panel means for receiving said signal from said processor means and for setting print parameters based on said signal received from said process means.

* * * * *